United States Patent [19]

Fath et al.

[11] Patent Number: 5,027,498

[45] Date of Patent: Jul. 2, 1991

[54] CONNECTOR APPLICATOR FOR RIBBON CABLE HAVING CABLE SLITTING AND CABLE TWISTING MEANS

[75] Inventors: Scott A. Fath, Harrisburg; William K. Seiersen, Hershey, both of Pa.

[73] Assignee: AMP Incorporated, Harrisburg, Pa.

[21] Appl. No.: 625,719

[22] Filed: Dec. 7, 1990

[51] Int. Cl.[5] ..... H01R 43/00; B21F 45/00

[52] U.S. Cl. ..... 29/566.1; 140/105

[58] Field of Search ..... 29/566.3, 566.1, 825, 29/749, 847, 755, 759, 868, 869, 872, 33 M, 564.4, 882, 745; 140/105, 118, 149; 72/413, 311, 478

[56] References Cited

U.S. PATENT DOCUMENTS

| | | | |
|---|---|---|---|
| 3,615,283 | 10/1971 | Lang | 29/745 X |
| 4,130,934 | 12/1978 | Asick et al. | 29/882 |
| 4,202,722 | 5/1980 | Paquin | 29/755 X |
| 4,470,195 | 9/1984 | Lang | 29/825 |
| 4,476,905 | 10/1984 | Maben | 72/478 X |
| 4,572,250 | 2/1986 | Maben | 140/105 |
| 4,662,968 | 5/1987 | Blevel et al. | 29/564.4 X |
| 4,729,152 | 3/1988 | Hammond et al. | 29/33 M |
| 4,757,845 | 7/1988 | Siwinski | 140/105 |
| 4,793,038 | 12/1988 | Gverout et al. | 29/749 X |
| 4,860,801 | 8/1989 | Nicholas et al. | 72/311 X |
| 4,954,100 | 9/1990 | McCleerey | 439/492 |

FOREIGN PATENT DOCUMENTS

| | | | |
|---|---|---|---|
| 8202279 | 7/1982 | World Int. Prop. O. | 29/868 |

*Primary Examiner*—William Briggs

[57] ABSTRACT

Apparatus for slitting a ribbon cable inwardly from its end thereby to separate a group of conductors from the remaining conductors of the cable, twisting the separated group of conductors, and presenting the twisted and reoriented or repositioned group of conductors to a connector installing device comprises cable slitter, cable twisting dies, and a cable feeding means in the form of rolls. The twisting dies are on the opposed surfaces of two blocks between which the cable is fed by the feed rolls. The slitting of the cable is carried out by slitting edges which are on the feed rolls. A knob is provided for rotating the feed rolls thereby to feed the cable past the twisting dies and to the connector applicator.

20 Claims, 12 Drawing Sheets

FIG. 1
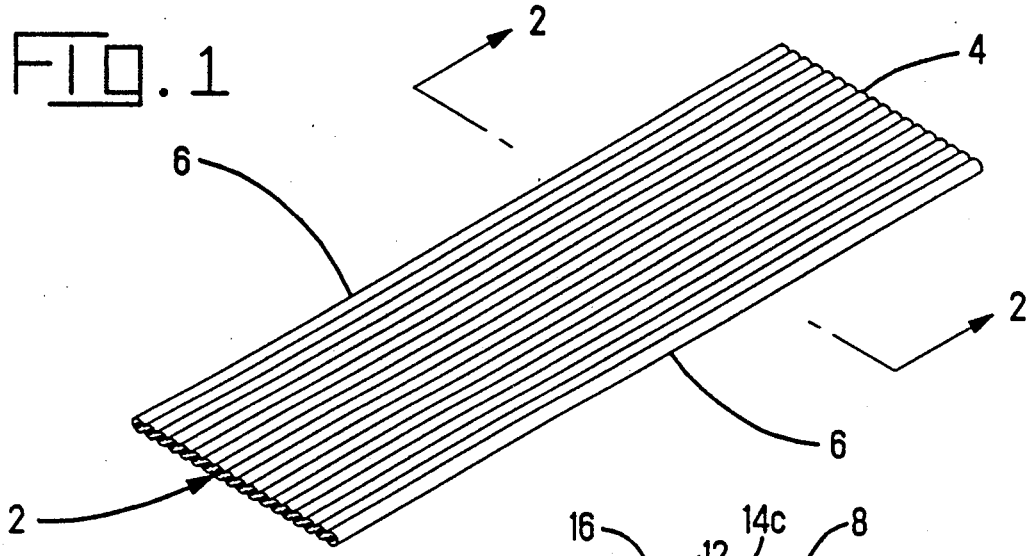
FIG. 2
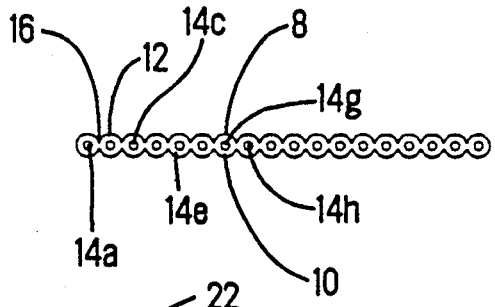
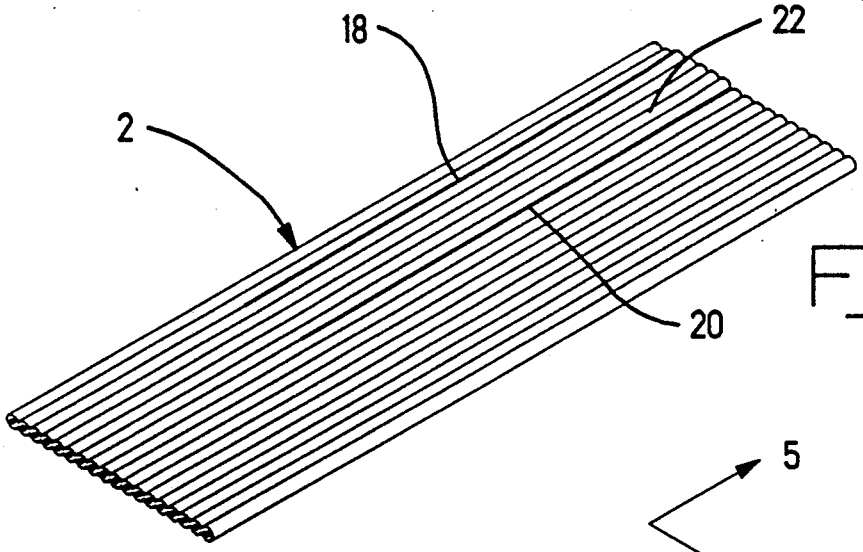
FIG. 3
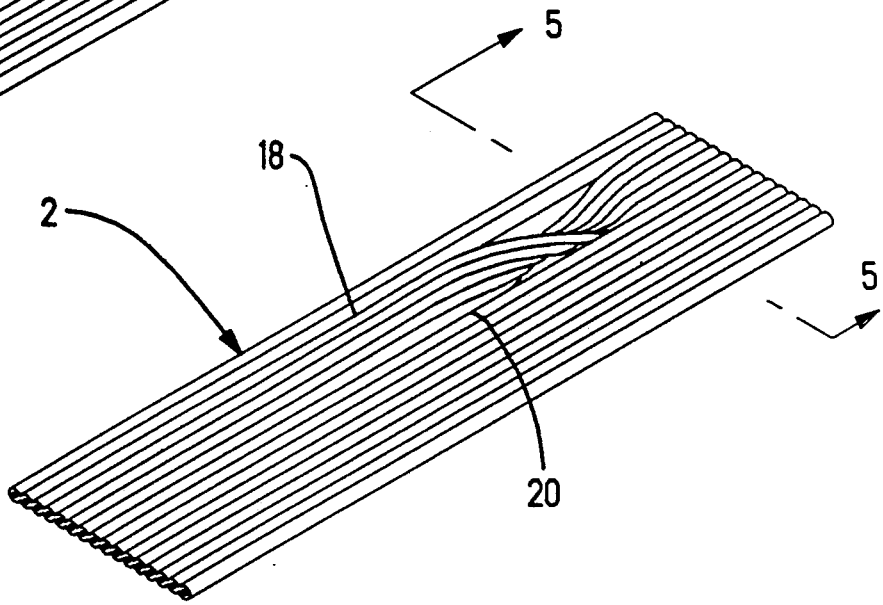
FIG. 4

FIG. 5
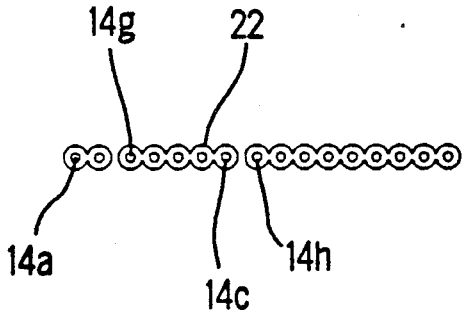
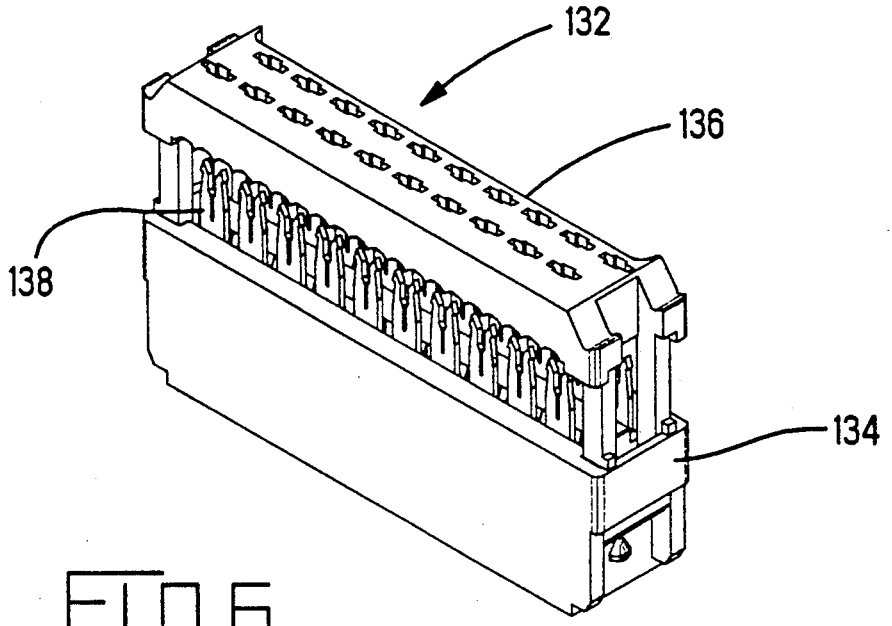
FIG. 6
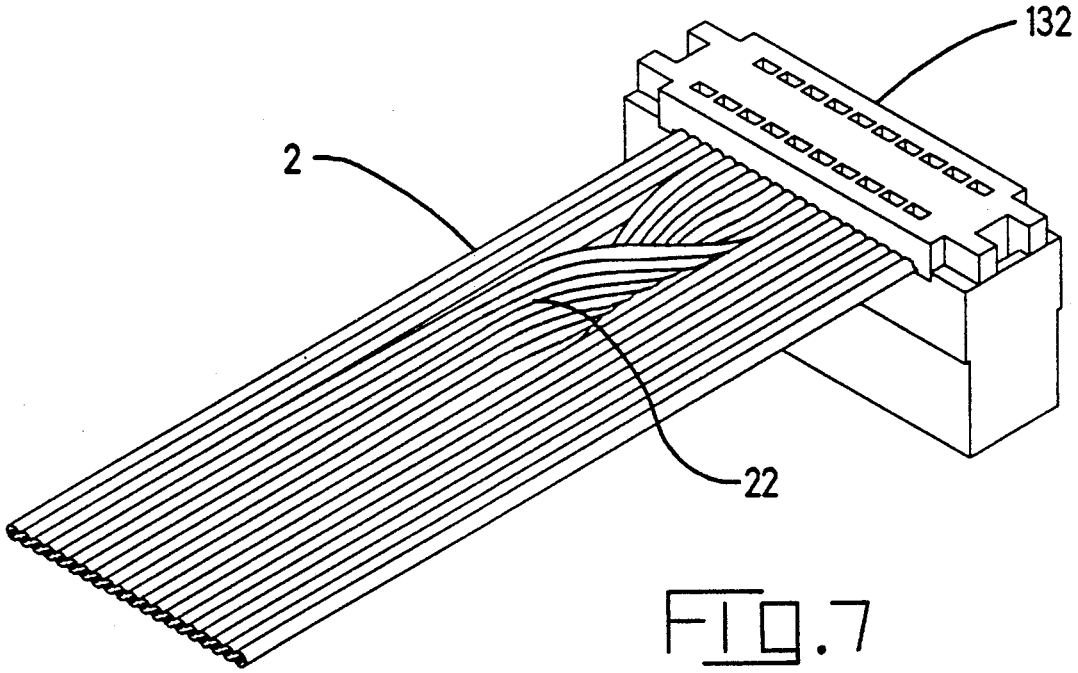
FIG. 7

CONNECTOR APPLICATOR FOR RIBBON CABLE HAVING CABLE SLITTING AND CABLE TWISTING MEANS

FIELD OF THE INVENTION

This invention relates to an apparatus for forming two parallel slits in a ribbon cable, thereby to isolate a band of conductors in the cable, and thereafter twisting the band through an angle of 180 degrees so that the positions of the isolated conductors are inverted. The invention also relates to an applicator for installing a connector on a ribbon cable in combination with a slitting and twisting apparatus.

BACKGROUND OF THE INVENTION

A ribbon cable comprises a plurality of parallel coplanar conductors which are contained in an extruded matrix of insulating material. Such cables are connected to other conductors by means of multi-contact connectors which have contact members spaced apart by the same distances as are the conductors in the cable. The connectors are conventionally installed on the end of the cable by simply positioning the cable in alignment with wire receiving slots in contact terminals in the connector and moving the cable laterally of its plane so that the conductors are inserted into the wire receiving slots in the terminals in the connector.

Ordinarily, the individual conductors in the cable are connected to spaced apart terminals in the connector in a manner such that the positions of the terminals exactly match the positions of the conductors in the cable. The end conductors on each side edge of the cable are connected to the terminals on each side of the connector and the intermediate conductors are connected to terminals which occupy the same positions in the connecter as are occupied by the conductors in the cable.

Under some limited circumstances, it is necessary to invert the positions of some of the conductors in the cable in order to connect predetermined conductors to terminals in the connector which are in positions that do not correspond to the original positions in the conductors in the cable. In other words, it is necessary to have "cross-overs" in the cable for selected conductors. In the past, these crossovers of selected conductors have been achieved by simply slitting the cable along two lines extending inwardly from its end so that the conductors which are to be inverted are isolated from the remaining conductors of the cable and the conductors which are to be inverted are contained in an isolated ribbon which is usually spaced from the side edges of the cable. The isolated group of conductors contained in the ribbon are then twisted through an angle of 180 degrees along the longitudinal axis of the isolated ribbon so that at the end of the cable, the positions of the conductors are inverted if the group of conductors contains an even number of conductors. If the group contains an odd number of conductors, the central conductor in the group will occupy the same position after the twisting operation has been carried out as it occupies in the main portion of the cable.

The operations of slitting and twisting described above are currently being carried out by means of simple cutting tools and by manual manipulation of the cable. The present invention is directed to the achievement of an apparatus which performs the slitting and twisting operations and which simultaneously installs a connector on the cable after the slitting and twisting operations have been carried out.

THE INVENTION

The invention comprises apparatus for slitting a ribbon cable along its axis inwardly from one end of the cable, thereby to separate a group of conductors from the remaining conductors of the cable, and for twisting the separated group of conductors through an angle of 180 degrees thereby to invert the positions of the conductors in the group. The apparatus comprises cable slitting means, twisting die means, and cable moving means for moving the cable relatively along a predetermined path. The slitting means and the twisting die means are in alignment with each other on the path with the twisting die means being downstream, with respect to the direction of movement of the cable along the path, from the slitting means. The twisting die means comprises guiding surfaces which are in alignment with the group of conductors and which are effective to twist the group of conductors through an angle of 180 degrees during movement of the group of conductors thereover so that upon relative movement of the cable along the path past the slitting means, the cable is slit thereby forming the separated group of conductors, and upon further movement of the cable the group of conductors are moved over the guiding surfaces and are twisted through an angle of 180 degrees.

In the disclosed embodiment, confining means are provided which confine the cable during movement along the path and the guiding surfaces are on the confining means. The confining means comprises a passageway extending therethrough with the guiding surfaces being opposed surface portions of the passageway.

The slitting and twisting apparatus is preferably used in conjunction with a connector applicator which installs a connector on the end of the cable after the group of conductors has been twisted.

THE DRAWING FIGURES

FIG. 1 is a perspective view of a portion of a ribbon cable.

FIG. 2 is a sectional view taken along the lines 2—2 of FIG. 1.

FIGS. 3 and 4 are views which illustrate the twisting and slitting operations which are carried out by an apparatus in accordance with the invention.

FIG. 5 is a sectional view taken along the lines 5—5 of FIG. 4 and showing the positions of conductors after inversion of the selected conductors in the cable.

FIG. 6 is a perspective view of an electrical connector intended for installation on the end of the cable.

FIG. 7 is a view showing the connector installed on the end of the cable.

Figure 12:
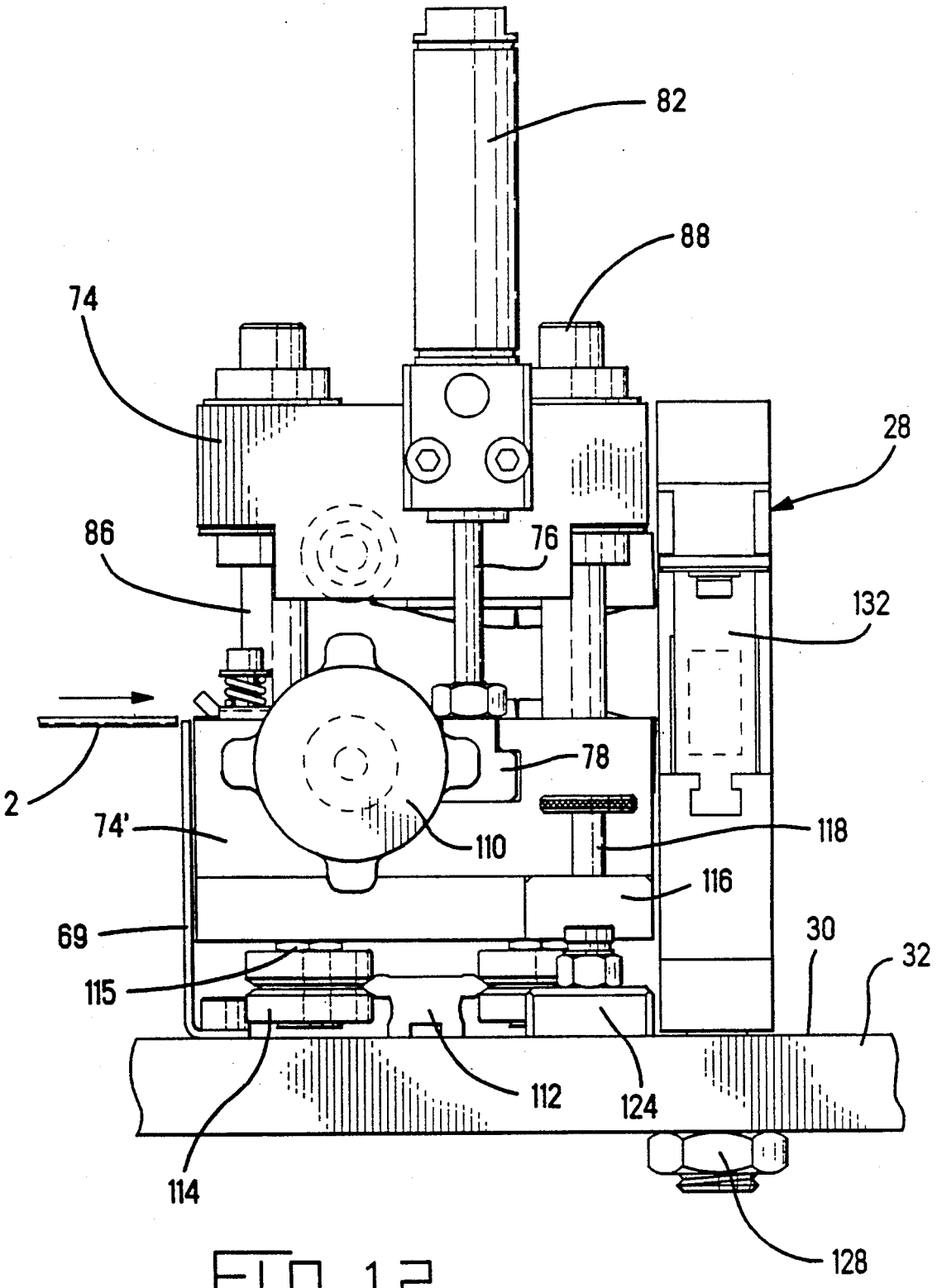
Figure 13:
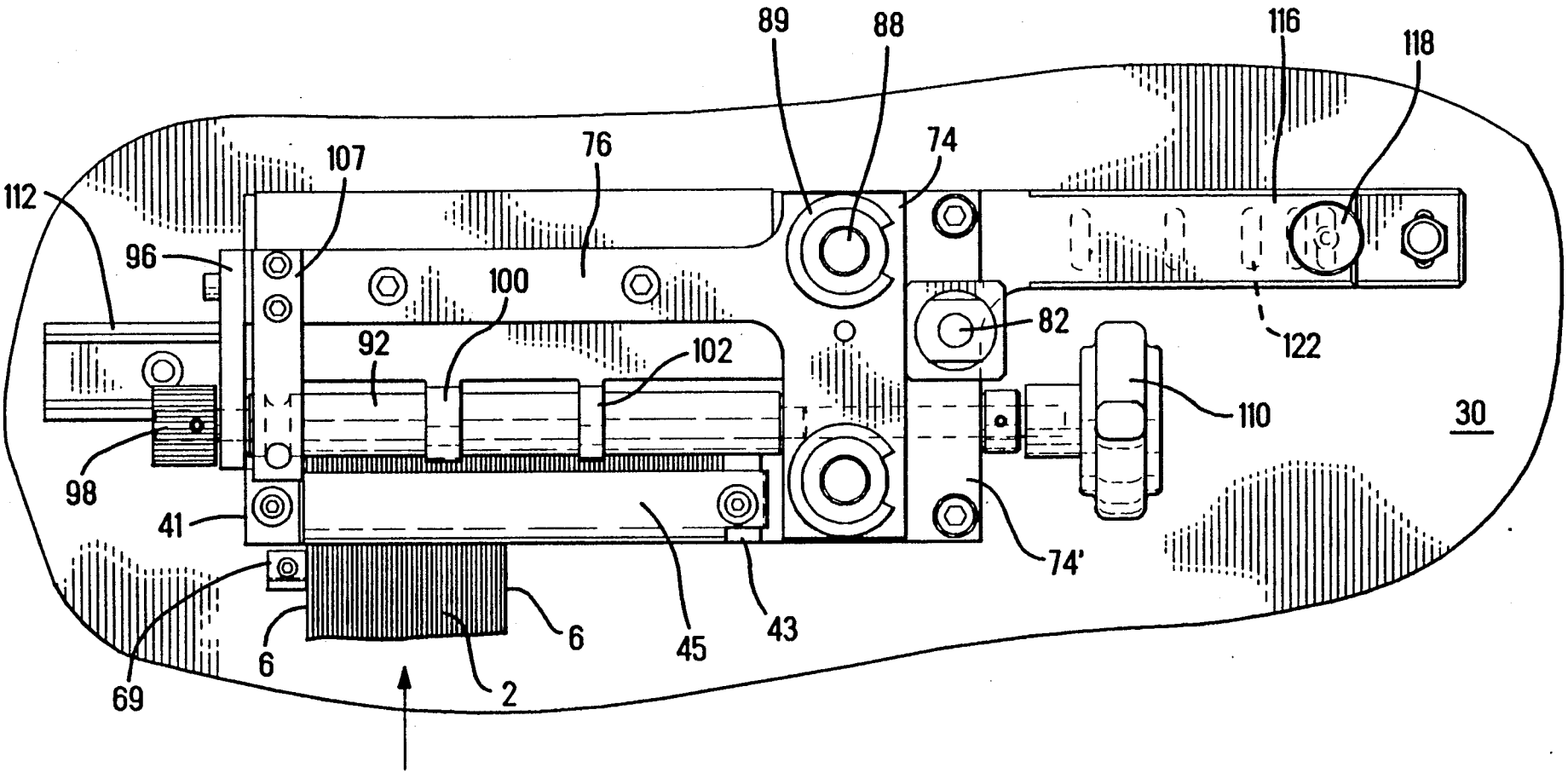

FIGS. 12 and 13 are side and top views, respectively, looking in the directions of the arrows 12—12 and 13—13 of FIG. 12.

Figure 14:
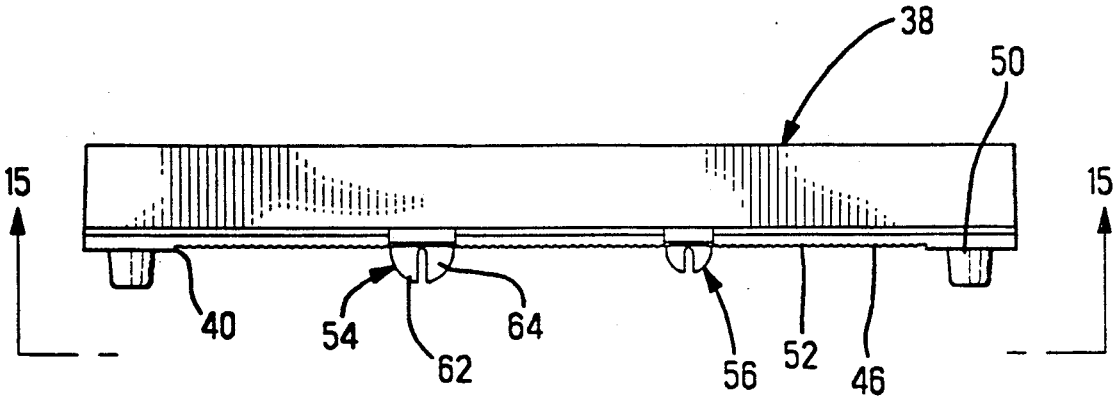
Figure 17:
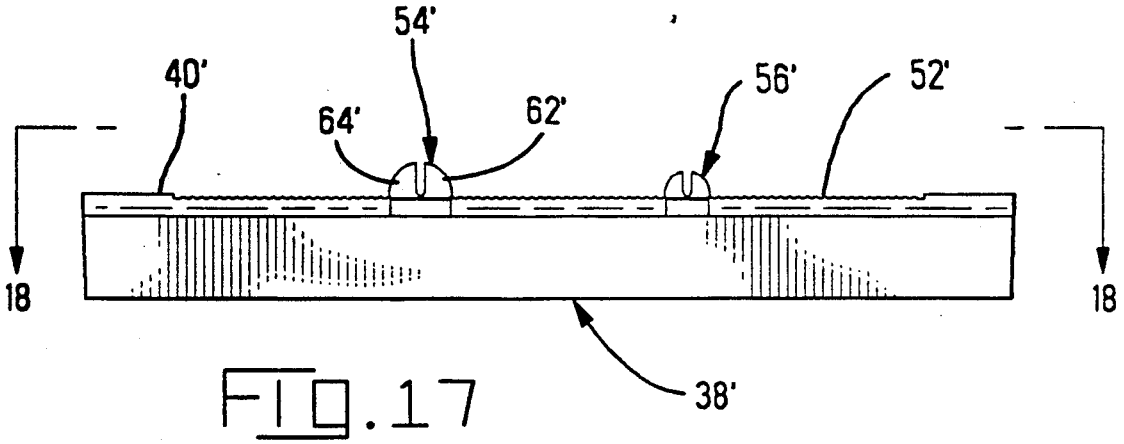

FIG. 14 is a frontal view of the upper confining and guiding block which forms part of the apparatus and which is opposed to the lower confining and guiding block shown in FIG. 17.

Figure 15:
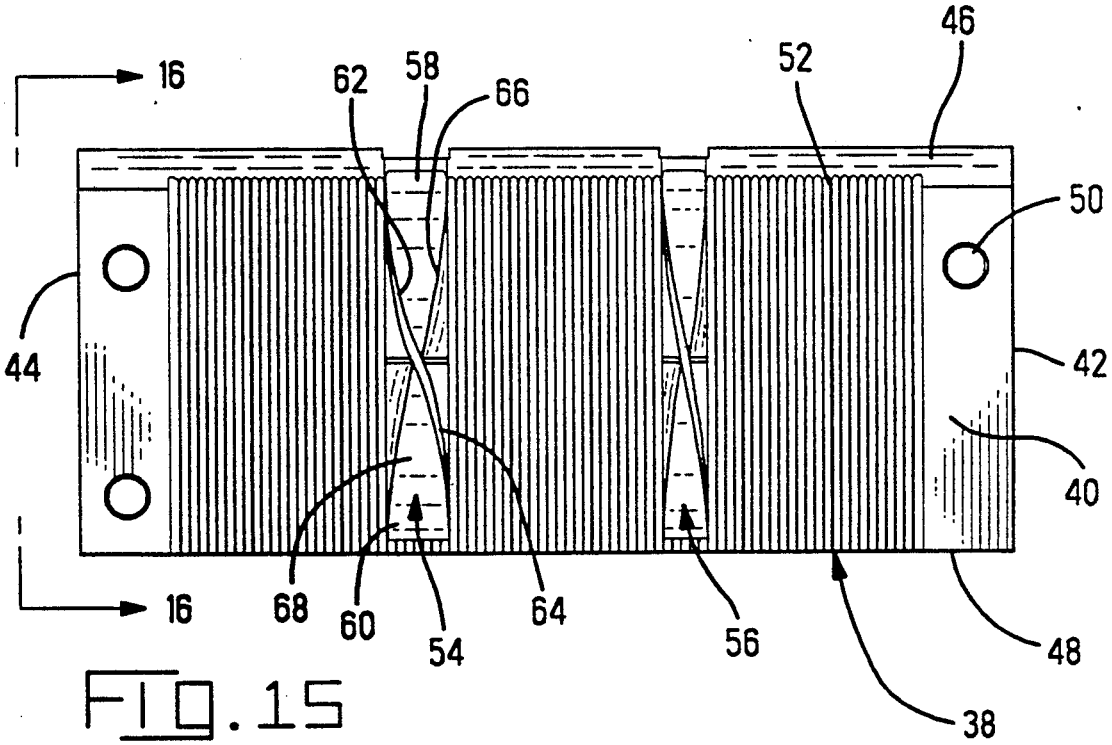
Figure 16:
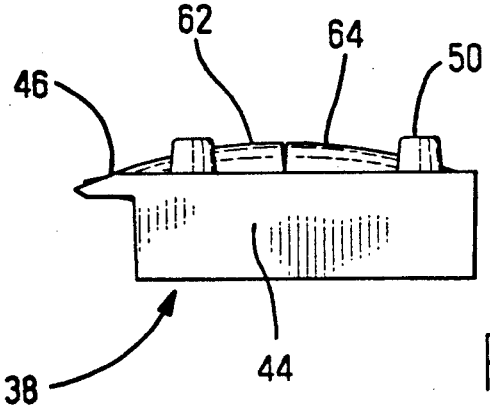

FIGS. 15 and 16 are views looking in the direction of the arrows 15—15 and 16—16 of FIGS. 14 and 15, respectively.

FIG. 17 is a frontal view of the lower confining and guiding block.

Figure 18:
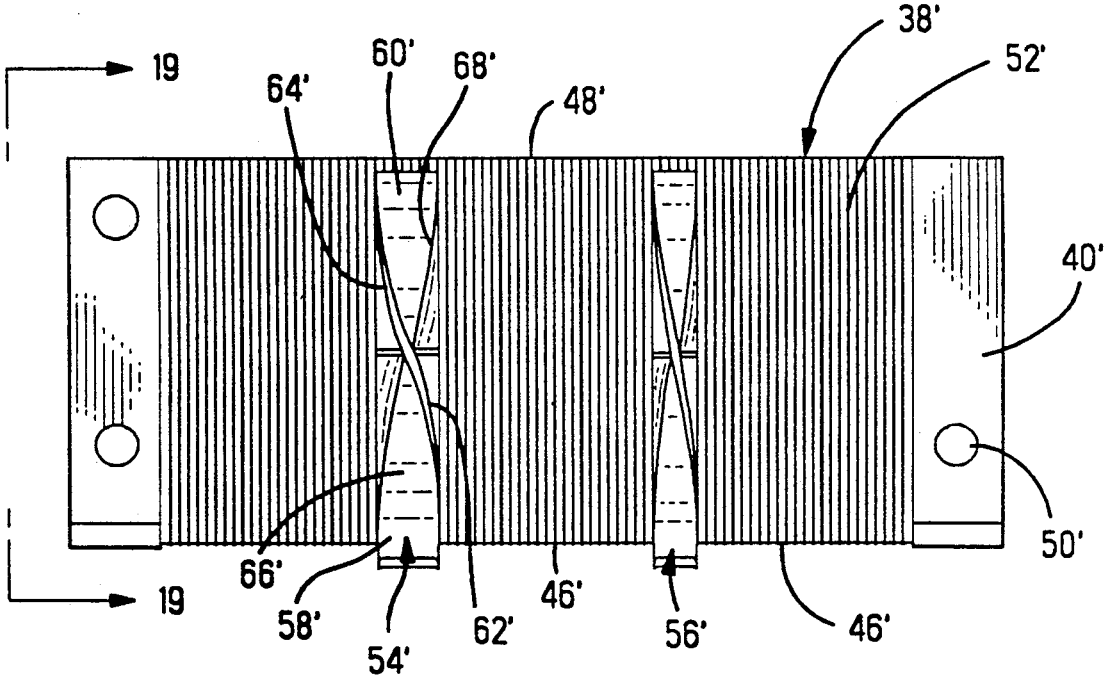
Figure 19:
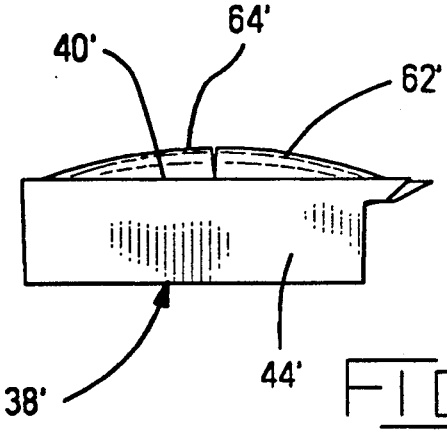

FIGS. 18 and 19 are views looking in the direction of the arrows 18—18 and 19—19 of FIGS. 17 and 18, respectively.

Figure 20:
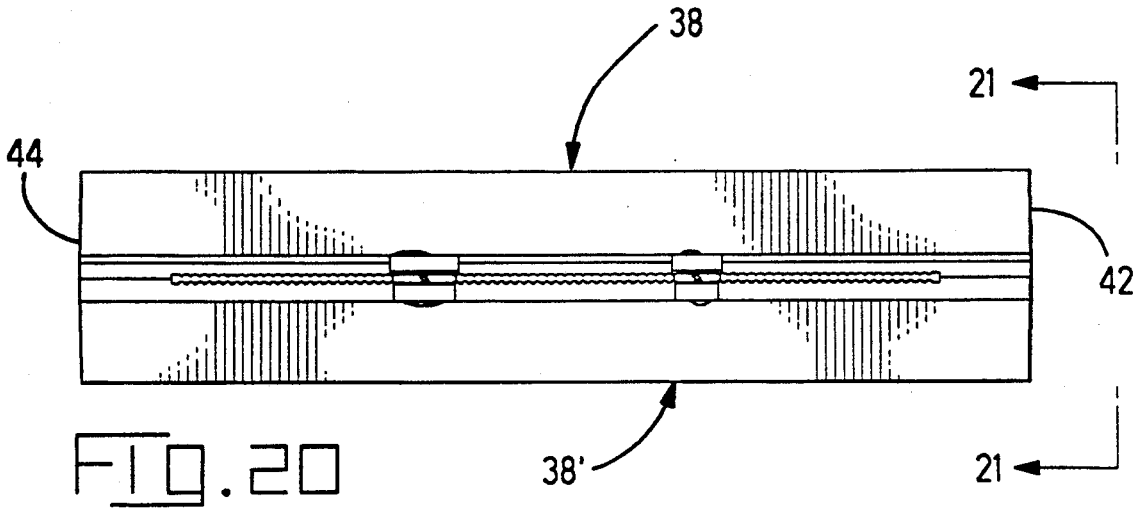

FIG. 20 is a frontal view of the confining and guiding blocks in their closed positions in which they are substantially against each other.

Figure 21:
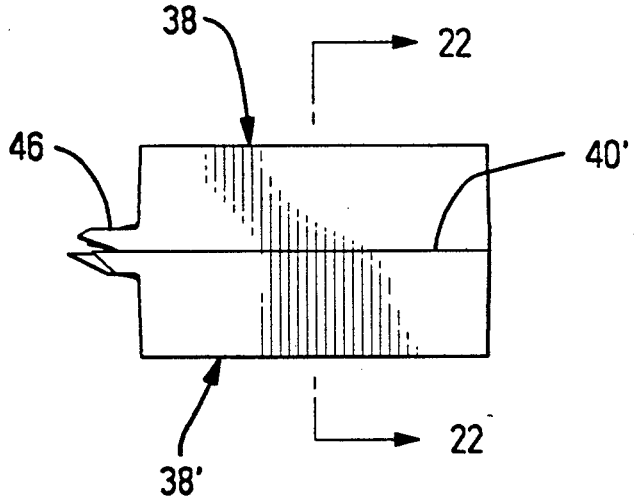

FIG. 21 is a side view looking in the direction of the arrows of FIG. 21.

Figure 22:
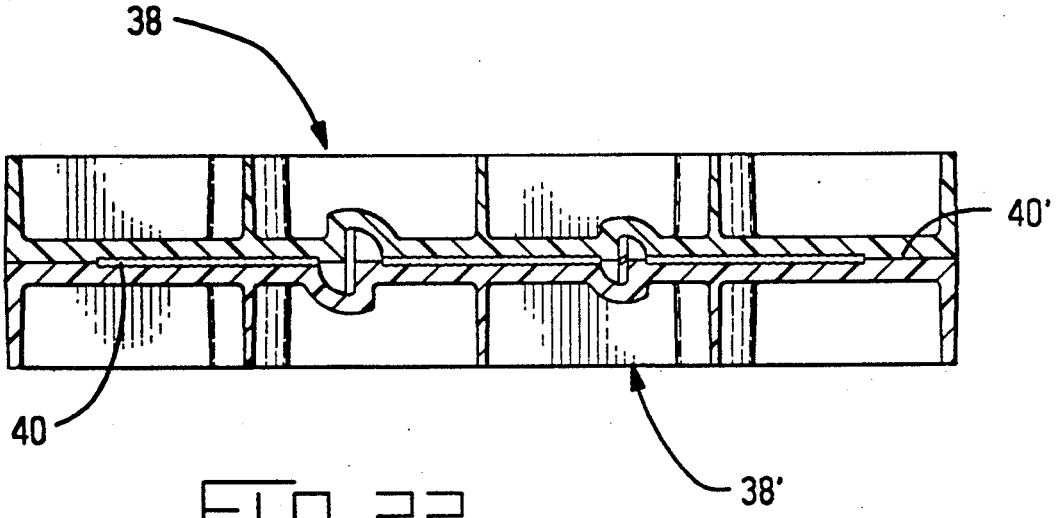

FIG. 22 is a sectional view looking in the direction of the arrows 22—22 of FIG. 21.

Figure 23:
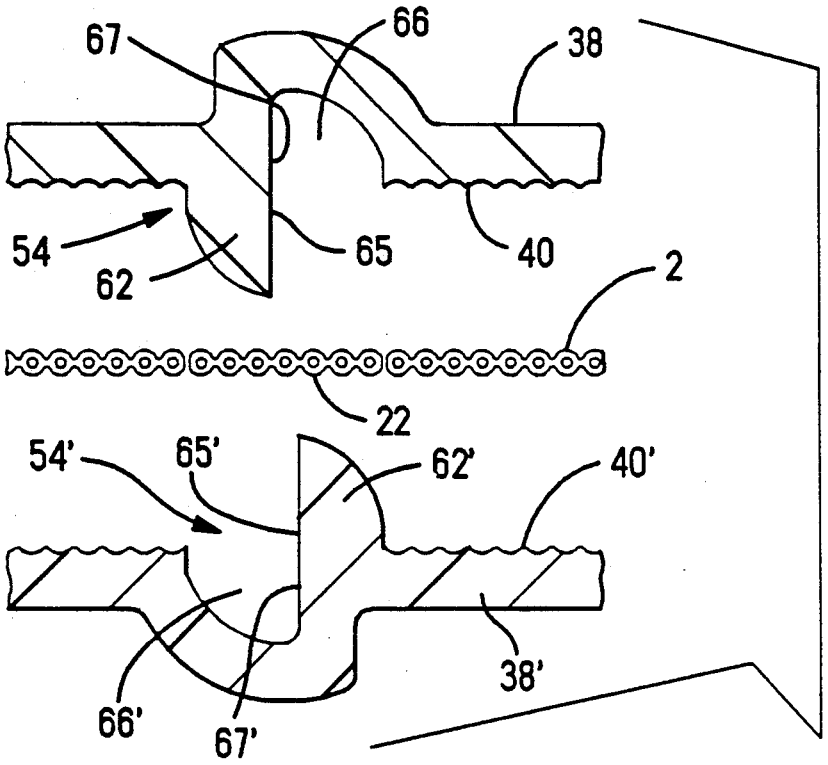
Figure 24:
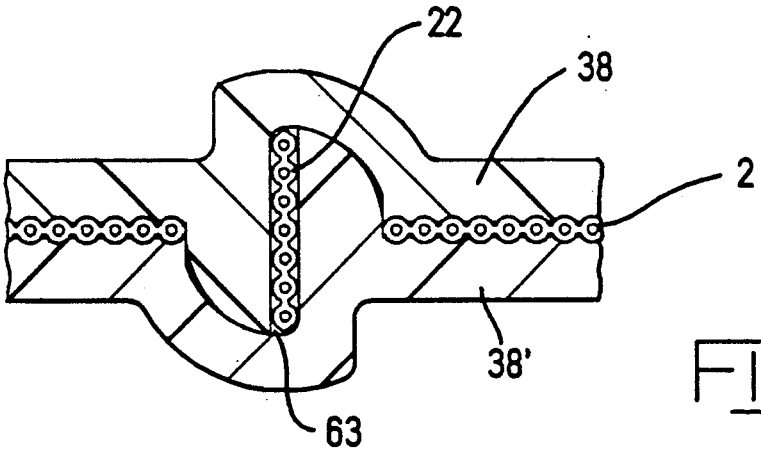

FIGS. 23 and 24 are enlarged cross-sectional views taken at approximately the mid-point of one of the twisting dies.

THE DISCLOSED EMBODIMENT

FIGS. 1-5 illustrate the operations which are carried out on a cable 2 in accordance with the invention. The cable 2 has a leading end 4, side edges 6, and upper and lower surfaces 8, 10. The cable contains a plurality of conductors 14 which are encased in extruded insulating material 12 with depressions 16 provided between adjacent conductors on the surfaces 8, 10.

A connector 132 which is intended for installation on the cable 2 comprises a body portion 134 and a cover 136 which is spaced from a cable receiving surface on the body portion prior to installation on the end of the cable. Contact terminals 138 extend from the upper surface of the body and each terminal has a wire receiving slot so that when the cable is positioned between the cover and the body with a conductor in alignment with each of the terminals, the conductors will be moved into the slots upon downward movement of the cover 136 until it is in its fully lowered and latched position. During normal installation then, the conductors identified as **14*a*, 14*b*, 14*c*, 14*d*, 14*e*, 14*f*, and 14*g* are connected to terminals which occupy corresponding positions in the connector. Under some circumstances, however, it is necessary to invert the positions of selected conductors and such inversions are carried out as shown in FIGS. 3-5**.

Assuming that the conductors which are to be inverted are those shown at **14*c*, 14*d*, 14*e*, 14*f*, and 14*g*, two parallel slits 18, 20 are formed in the cable by severing the cable between the conductors 14*b* and 14*c* and severing the cable between the conductors 14*g* and 14*h*. These slits isolate a section or band 22 of the cable which contains the group of conductors that are to be inverted. The isolated section 22 is then simply twisted through an angle of 180 degrees as shown in FIG. 4 and the twisted section is then repositioned in the plane of the cable as shown in FIG. 4. Conductors 14*c*-14*g* will then occupy the positions shown in FIG. 5. It will be noted that conductor 14*e* has not changed its position, although if an even number of conductors is contained in the separated group, all of the conductors will be inverted. After the separated band has been twisted as shown in FIG. 4**, the connector can be installed on the end of the cable in the conventional known manner.

Heretofore the slitting and twisting operations shown in FIGS. 3-5 have been carried out manually and the cable, in the condition shown in FIG. 4, thereafter carried to a bench applicator which installs the connector on the end of the cable. The apparatus 26 of the present invention carries out all of the slitting and twisting operations and simultaneously presents the end portion of the cable to a module 28 containing the connector which is to be installed on the cable. Modules of the general type shown at 28 are commonly known and are described in U.S. Pat. Nos. 4,682,391 and 4.870,752. The module 28 is in turn used with a suitable press, not specifically shown.

Figure 8:
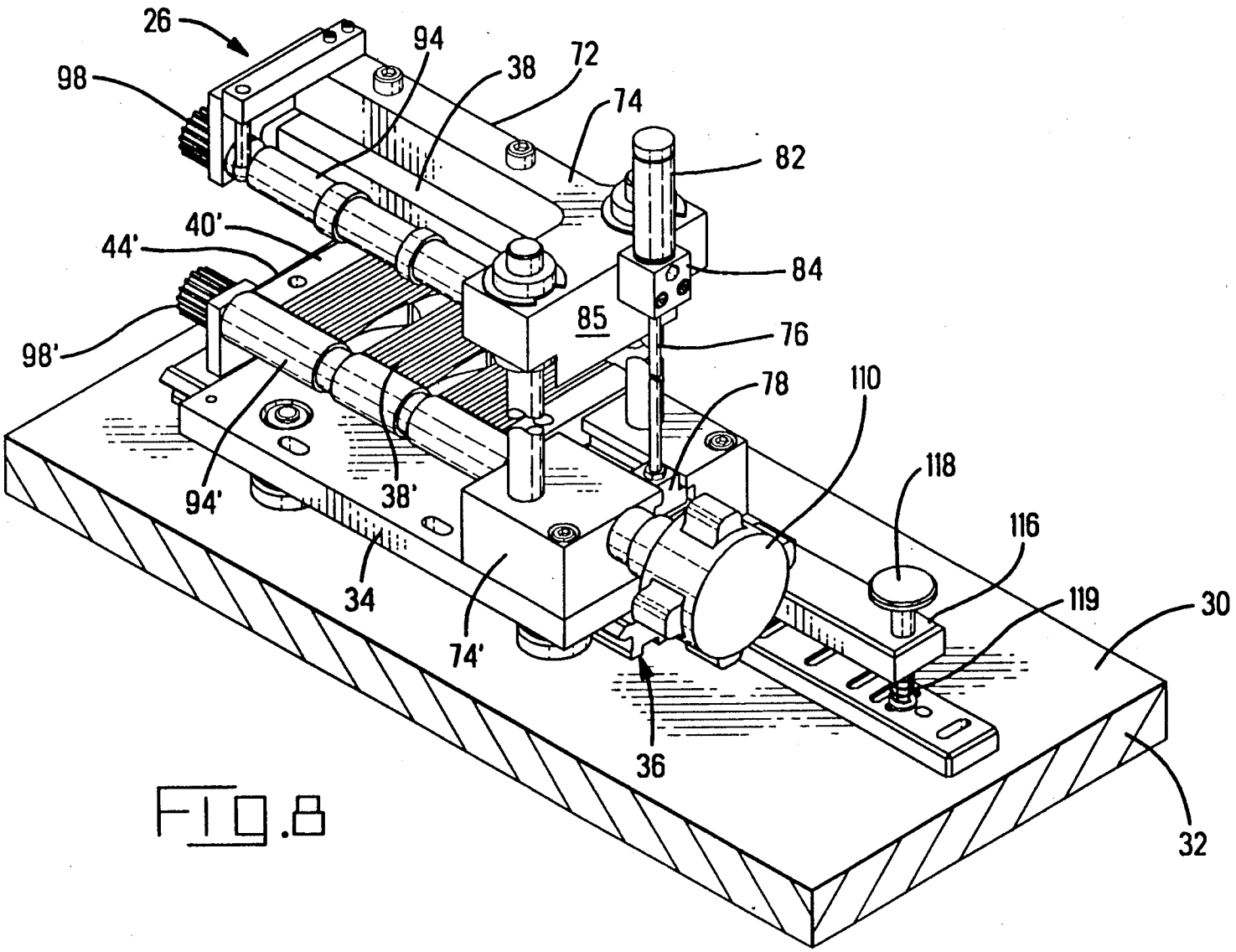
FIG. 8 is a perspective view of an apparatus in accordance with the invention, this view showing the positions of the parts when the confining blocks and the feed rolls are in their separated or open positions to permit removal of a cable from the apparatus.

The apparatus 26 is mounted on the upper surface 30 of a fixed support plate 32 and comprises a base plate 34 which is adjustably mounted on surface 32 by means of a slide assembly 36 which permits movement of the apparatus rightwardly or leftwardly as viewed in FIG. 8 for reasons which will be explained below.

Figure 9:
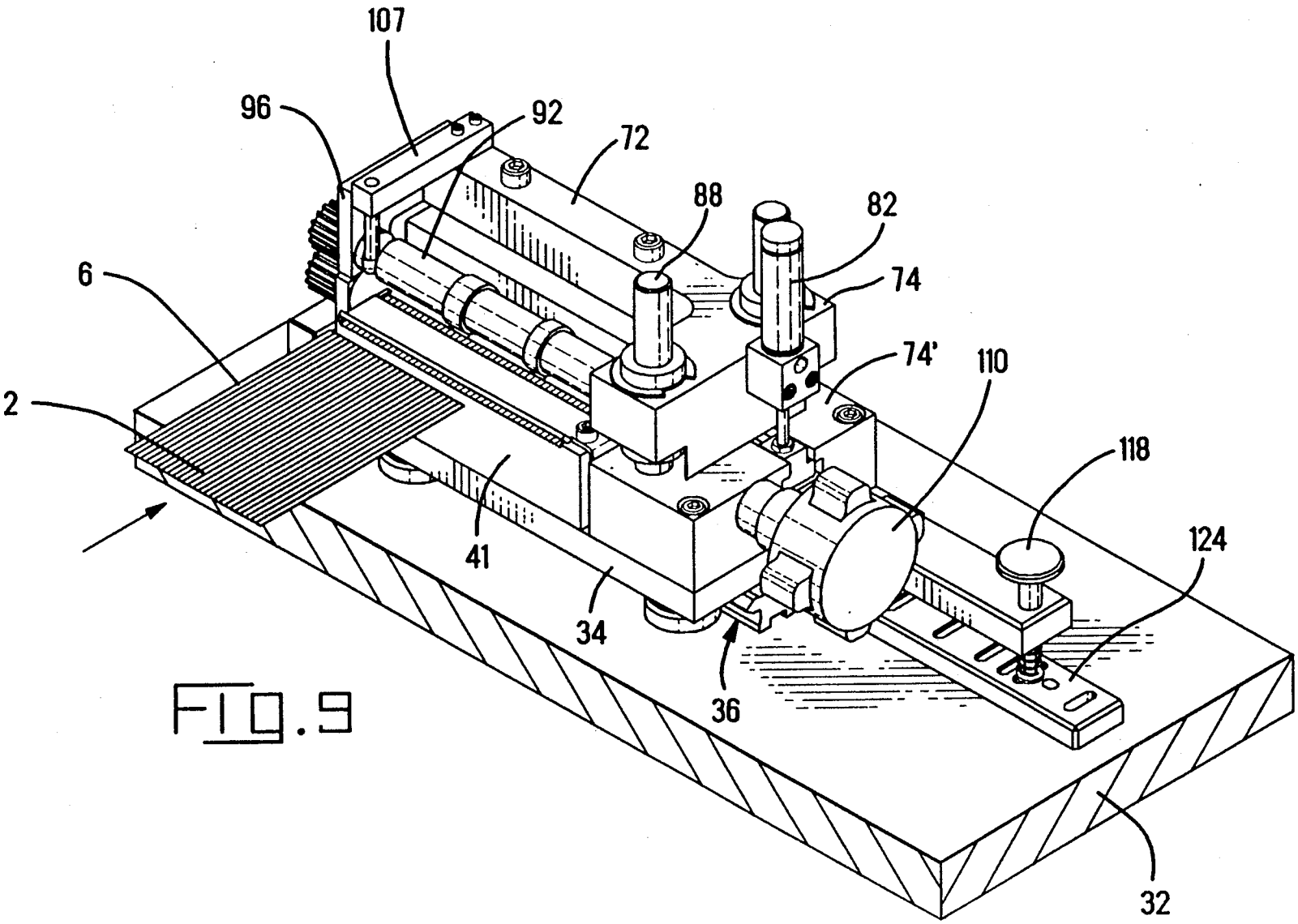
FIG. 9 is a view similar to FIG. 8 but showing the feed rolls and the confining blocks in their closed or adjacent positions.
Figure 10:
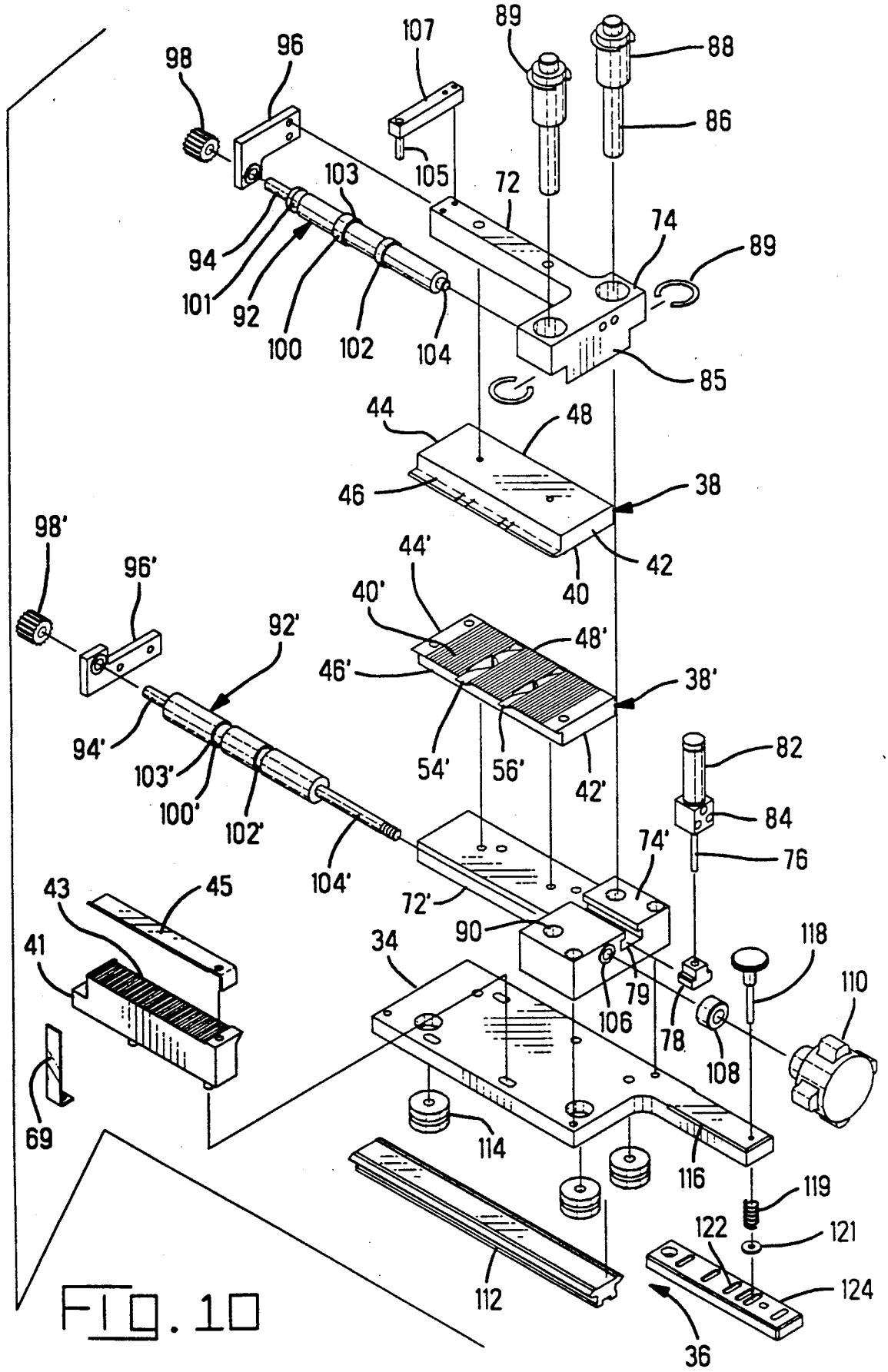
FIG. 10 is a perspective view of the apparatus with the parts exploded from each other.

The cable is fed into the apparatus from the left on FIG. 9 and advanced between the opposed surfaces 40, 40' of opposed blocks 38, 38'. The blocks are of molded insulating material and are hollow as shown in FIG. 22. Block 38 is shown as a solid block in FIG. 10 for drawing simplification purposes. The upper and lower blocks are similar, but not identical to each other and corresponding parts of the blocks will therefore be identified by the same reference numerals differentiated by prime marks.

The upper block 38 has oppositely facing ends 42, 44 and sides 46, 48, the side 46 being the cable entry side for the cable and the side 48 being the cable exit side which is adjacent to the module. As shown, projecting lips are provided on the sides 46, 46' of the blocks to guide the cable 2 into the space between the opposed surfaces 40, 40'. The blocks, and their associated rollers 92, 92' are movable between open positions as shown in FIG. 8 and closed position as shown in FIG. 9. When in use, the two blocks are adjacent to each other as shown in FIG. 9 but must be moved apart to permit removal of a finished assembly comprising the prepared end portion of a cable having a connector installed thereon. In order to ensure that the two blocks are precisely located, depending bosses 50 are provided on the upper block 38 and corresponding openings 50' are provided in the block 38'.

The opposed surfaces of the blocks have flutes 52, 52', FIGS. 15 and 18, extending from their entry sides 46, 46' to their exit sides 48, 48'. The flutes are dimensioned such that an individual conductor 14 will be located in each of the flutes and the ridges between adjacent flutes will enter a recess 16 in the surfaces 8, 10 of the cable.

Opposed surfaces 40, 40' have opposed portions 54, 54' which define a first twisting die and portions 56, 56' which define a second twisting die when the blocks 38, 38' are adjacent to each other as shown in FIG. 9. The two dies differ only in that the first die is designed to twist a band 22 having seven conductors therein and the second die is designed to twist a band having five conductors. The twisting die portions 54, 54' are described below.

The surface portions 54, 54' define a passageway which extends from the sides 46, 46' of the blocks 38, 38' to the exit sides 48, 48'. The passageway has a rectangular crosssection which conforms to the cross-section of the band 22.

The passageway has horizontal portions at the entry sides 46, 46' and at the exit sides 48, 48'. The horizontal portions of the passageway are formed by flat horizontal surfaces 58, 60, 58' and 60' of surfaces 40, 40', see FIGS. 15 and 18. The surface 40 has contoured projections 62, 64, and adjacent contoured recesses 66, 68. The surface 40' has complementary projections 62', 64', and recesses 66', 68'. The recesses 66' and 68' receive the projections 62, 64 and the recesses 66, 68 receive the projections 62', 64'. The opposed surfaces 65, 65' of the projections and one sidewall 67, 67' of each recess define the helical twisting portion of the passageway which twists the band 22 as it moves through the space between the opposed surfaces 40, 40'.

FIGS. 23 and 24 show the passageway at 63 and the opposed sidewalls of the projections 62, 62' and recesses 66, 66' which define the passageway. These views show the passageway at about the mid-point of the twisting die where the passageway 63 is in a vertical orientation. If similar cross-sectional views were taken at locations spaced from the mid-point of the twisting dies, the passageway would be slanted. The twisting die portions 62,62' extend from sides 46,46' to a central location and the twisting die portions 64,64' extend from the central location to the sides 48,48'. The twisting die portions 62, 62' twist the band 22 through an angle of 90 degrees and the twisting die portions 64, 64' twist the band through an additional 90 degree angle.

Figure 11:
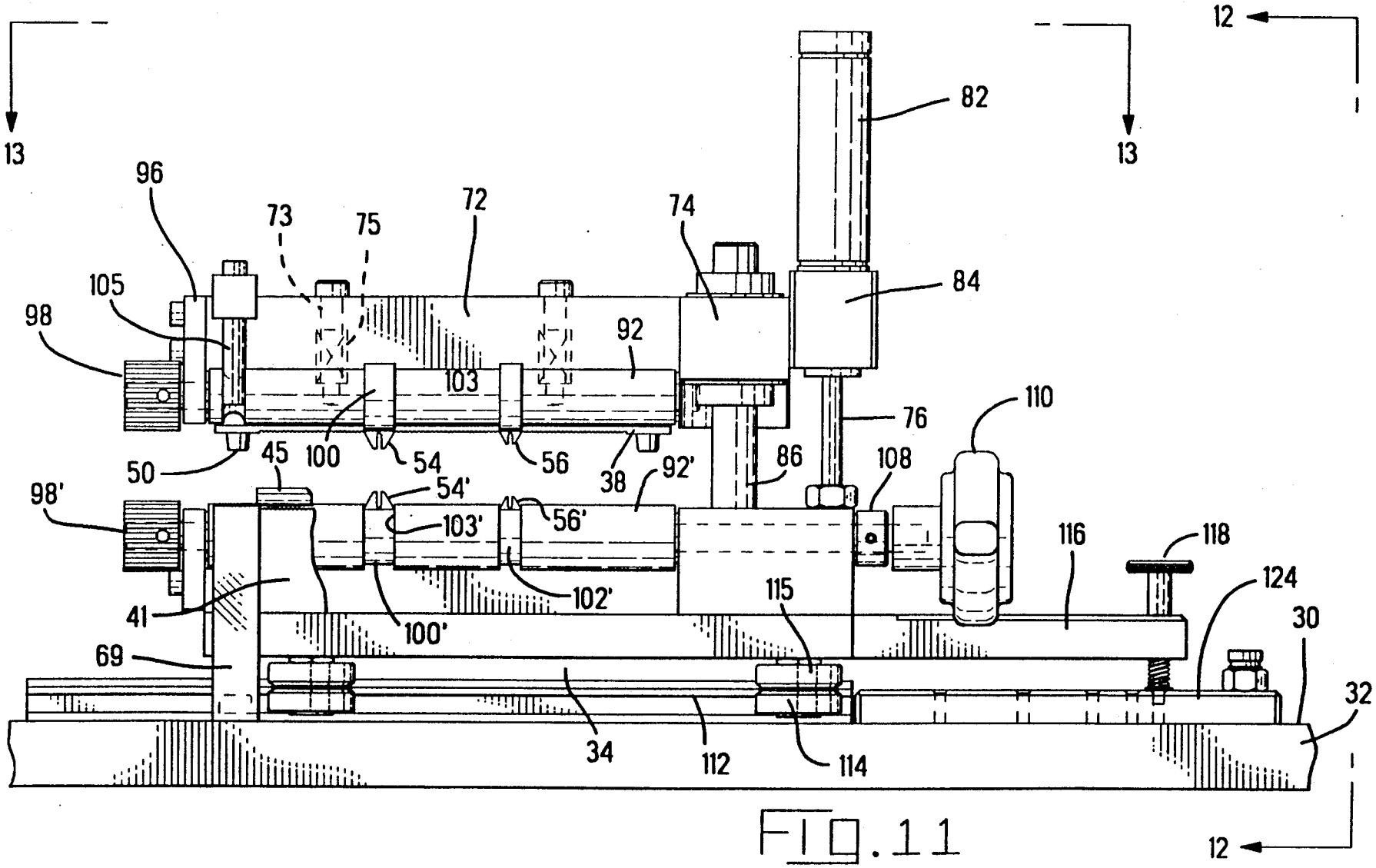
FIG. 11 is a frontal view of the apparatus.

The upper block 38 is secured to an arm 72 which extends from a support block 74. Block 38 is secured by means of fasteners 73 and is resiliently supported by springs 75 as shown in FIG. 11 so that the upper block will be resiliently held against the lower block when the parts are in the positions of FIG. 11. The lower block 38' is secured by suitable fasteners to an arm 72' which extends from a lower support block 74'. The upper support block 74 is lowered from the position of FIG. 8 to the position of FIG. 9 by means of a piston rod 76 which extends from a piston cylinder 82. The end of the piston rod is secured in a keying block 78 which in turn is positioned in a keyway 79 in the lower support block 74'. The piston rod extends from the piston within the piston cylinder 82 and the cylinder head of this piston cylinder is fastened to the side surface 85 of the upper block 74. The upper block 74 is guided by means of guide posts 86 which are press fitted in openings 90 in the lower block 74'. Ball bearing bushings 88 are mounted in openings in block 74 and the posts 86 extend through these bushings. The cable is fed through the apparatus and the slits are formed in the cable by upper and lower rolls 92, 92'. The upper roll 92 has a reduced diameter left-hand end as viewed in FIG. 10 which extends through an L-shaped bracket 96 that is secured to the end of the arm 72. The reduced diameter end 94 has a gear 98 on its end which meshes with a similar gear 98' on the reduced diameter end 94' of the lower roll 92'. The lower roll is also supported by an L-shaped bracket 96' which is secured to the end of the arm 72'. Intermediate their ends, the rolls 92, 92' have the slitting means which is in the form of enlarged diameter portions 100, 102 on the roll 92 and circumferential recesses 100', 102' in the roll 92' The edges 103, 103' of the enlarged diameter sections of roll 92 and the circumferential recesses of the roll 92' function as shearing edges and form the required slits in the cable as it is moved or fed therepast upon rotation of the rolls.

The lower roll 92' has an elongated reduced diameter end portion 104' which extends rotatably through an opening 106 in the lower support block 74'. The projecting end portion has a collar 108 thereon which is secured in position by a set screw to prevent axial movement of the roll. The end of the reduced diameter portion 104' is threaded and has a knob 110 thereon so that the rolls can be rotated by the operator by simply turning the knob 110 in a clockwise direction as viewed in FIG. 11 to feed the cable along its path of movement through the apparatus.

The upper roller 92 has a circumferential recess 101 which receives a depending pin 105 on an arm 107 which is fixed to the arm 72. The pin and recess serve to restrain the roller against axial movement.

A cable guide and a cable positioning stop are provided adjacent to the lower roller 92' precisely to locate the cable 2 with respect to the rollers. The guide comprises a guide block 41 which is fixed to the plate 34 and which has an upper surface 43 having flutes thereon similar to the flutes on the blocks 38, 38'. A cover 45 is provided which is spaced from the surface 43 for confining the cable. The positioning stop 69 is fixed to the fixed plate 32 and is located in front of the left-hand side end of the block 41, see FIG. 13. The cable is located against this stop when it is fed into the rollers.

The slide assembly 36 comprises a fixed elongated slideway 112 having side edges which are tapered and which are received in circumferential grooves in the rollers 114 of roller and journal assemblies 115 that are supported in the plate 34. The slideway and rollers permit movement of the entire apparatus along the length of the slideway and the precise position of the apparatus is determined by a locking pin 118 which extends through an arm 116 on the base plate 34. This locking pin is resiliently biased downwardly, as viewed in FIG. 11, by a spring 119 which is between a retaining ring 121 and the underside of arm 116. The pin can be pulled upwardly to move the assembly leftwardly or rightwardly in FIG. 11. The end of the pin is received in one of a number of spaced apart slots 122 in a positioning bar 124 which is secured to the upper surface of the fixed base plate 32.

As shown in FIG. 12, the module 28, which holds the connector which is to be installed on the end of the cable is supported by set screws 128 which are threaded through the base plate 32. As previously explained, a press ram is provided but is not specifically shown which engages the module and causes the cover portion thereof to be moved downwardly into fully assembled relationship with the body when the connector is installed on the cable end.

Two sets of twisting dies are provided on the plates 38, 38' in order to permit reorientation of a group of five conductors or a group of seven conductors, depending upon the location of the apparatus on the base plate with reference to a fixed guide member. It will be understood that the provision of the specifically shown twisting dies are the result of a particular requirement and that more or fewer sets of twisting dies might be required and for that matter it is not required that the entire apparatus be adjustable relative to the position of the module.

The operation of the apparatus is as follows. The operator first pressurizes the piston cylinder 82 thereby to lower the block 74 from the position of FIG. 8 to the position of FIG. 9 so that the guide blocks 38, 38' are substantially against each other and the gears 98, 98' on the ends of the rolls 92, 92' are in engagement. The operator then locates the leading end of the cable at the entrance of the two assembled blocks and rotates the knob 110. Rotation of the knob 110 causes the rolls to feed the cable through the space between the two blocks 38, 38' and form the desired pair of slits in the cable. The separated conductors in the group of conductors are moved through the appropriate one of the twisting dies and the separated group of conductors are thereby inverted so that they occupy the positions shown, for example, in FIG. 5. Continued rotation of the knob 110 feeds the leading end of the cable into the connector located in the module so that the crimping or installation press can be pressurized to bring about installation of the connector on the end of the cable. The operator then reverses the piston cylinder 82 causing the block 74 to move upwardly so that the completed cable and connector assembly can be removed leftwardly as viewed in FIG. 11.

The adjustability of the apparatus by means of the slide system 36 permits the slitting and twisting of cables 2 having varying widths and different numbers of conductors. Ordinarily, only one of the twisting dies is used in a particular cable and the apparatus shown in intended for use with cables having a width which is less than the widths of the blocks 38, 38'. When the twisting dies 56, 56' are used in a twisting and slitting operation, the entire apparatus is moved leftwardly from the position shown in FIG. 13 so that the twisting dies 54, 54' are located to the left of the fixed stop 69 and the dies 56, 56' are to the right of, and close to, the stop 69.

A principal advantage achieved by the invention is that the slitting and twisting operations are carried out by the machine and the operator need perform no operations other than positioning the cable in the machine and rotating the knob 110. The slits in the cable are made very precisely without damage to any of the conductors and the twists are made accurately so that the conductors are properly oriented when the end of the cable is fed into the connector.

We claim:

1. Apparatus for slitting a ribbon cable along its axis inwardly from one end of the cable, thereby to separate a group of conductors from the remaining conductors of the cable, and for twisting the separated group of conductors through an angle of 180 degrees thereby to invert the positions of the conductors in the group, the apparatus comprising:

cable slitting means, cable twisting die means, and cable moving means for moving the cable relatively along a predetermined path, the slitting means and the twisting die means being in alignment with each other on the path with the twisting die means being downstream, with respect to the direction of relative movement of the cable along the path, from the slitting means, the twisting die means comprising guiding surfaces which are in alignment with the group of conductors and which are effective to twist the group of conductors through an angle of 180 degrees during movement of the group of conductors thereover whereby, upon relative movement of the cable along the path past the slitting means, the cable is slit thereby forming the separated group of conductors, and upon further movement of the cable, the group of conductors are moved over the guiding surfaces and are twisted through an angle of 180 degrees.

2. Apparatus as set forth in claim 1 characterized in that cable confining means are provided which confine the cable during movement along the path.

3. Apparatus as set forth in claim 1 characterized in that confining means are provided which confine the cable during movement along the path, the guiding surfaces being on the confining means.

4. Apparatus as set forth in claim 3 characterized in that the confining means has a passageway extending therethrough, the guiding surfaces comprising surfaces of the passageway.

5. Apparatus as set forth in claim 1 characterized in that confining and guiding means are provided for confining and guiding the cable during movement along the path, the confining and guiding means comprising first and second blocks which are substantially against each other and which have opposed surfaces, the twisting die means being on the opposed surfaces.

6. Apparatus as set forth in claim 5 characterized in that the twisting die means comprises projecting portions and adjacent recesses on the opposed surfaces which define a helical passageway extending through the first and second blocks.

7. Apparatus as set forth in claim 6 characterized in that the cable has axially extending depressions between adjacent conductors on at least one surface thereof, and flutes are provided on one of the opposed surfaces which receive portions of the cable between adjacent depressions.

8. Apparatus as set forth in claim 2 characterized in that the slitting means comprises at least one slitting edge.

9. Apparatus as set forth in claim 2 characterized in that the slitting means comprises slitting rolls.

10. Apparatus as set forth in claim 2 characterized in that the cable moving means comprises feed rolls.

11. Apparatus as set forth in claim 9 characterized in that the slitting means comprises slitting edges on the feed rolls.

12. Apparatus as set forth in claim 2 in combination with a connector applicator for installing an electrical connector on the one end of the cable, the connector applicator being located downstream from the twisting die means.

13. Apparatus for inverting the positions of a group of juxtaposed conductors in a ribbon cable and thereafter installing a connector on the cable, the apparatus comprising:

cable feeding means for feeding the cable along a cable feed path, cable slitting means, cable twisting means, and a connector applicator, the slitting means, the twisting means, and the applicator being on the feed path with the twisting means located downstream, relative to the direction of cable feeding, from the slitting means and with the applicator downstream from the twisting means, the slitting means and the twisting means being in alignment, the slitting means being effective axially to slit the cable during feeding of the cable therepast thereby to separate the group of juxtaposed conductors from the remaining conductors in the cable, the twisting means comprising guiding surfaces on the feed path for guiding the separated group of conductors along a helical path so that the separated group is twisted through an angle of 180 degrees whereby, the cable is fed to the applicator with the positions of the conductors in the juxtaposed group inverted at the leading end of the cable when the leading end arrives at the applicator.

14. Apparatus as set forth in claim 13 characterized in that confining and guiding means are provided for confining and guiding the cable during movement along the path, the confining and guiding means comprising first and second blocks which are substantially against each other and which have opposed surfaces, the twisting means being on the opposed surfaces.

15. Apparatus as set forth in claim 14 characterized in that the twisting means comprises projecting portions and adjacent recesses on the opposed surfaces which define a helical passageway extending through the first and second blocks.

16. Apparatus as set forth in claim 15 characterized in that the cable feeding means comprises feed rolls.

17. Apparatus as set forth in claim 16 characterized in that the slitting means comprises slitting edges on the feed rolls.

18. A twisting die assembly for twisting an isolated portion of a ribbon cable through an angle of 180 degrees, the isolated portion comprising a band which is separated from the remainder of the cable by a slit extending inwardly from one end of the cable, the band containing a plurality of conductors, the positions of the conductors in the band being inverted after the band has been twisted, the twisting die assembly comprising:

a die block assembly having a cable entry side and a cable exit side, a cable passageway extending through the die block assembly from the cable entry side to the cable exit side, the passageway having a width which is sufficient to receive the cable, the cable passageway comprising a twisting portion and a straight portion, the twisting portion having a width equal to the width of the band, the twisting portion having opposed surfaces which extend helically through an angle of 180 degrees, the straight portion having opposed surfaces which are parallel and which are straight between the entry side and the exit side whereby, upon movement of the cable through the passageway, the band is twisted through an angle of 180 degrees relative to the remainder of the cable.

19. A twisting die assembly as set forth in claim 18 characterized in that the die block assembly comprises first and second die blocks which are substantially against each other and which have opposed first and second surfaces, the cable passageway being between the opposed surfaces.

20. A twisting die assembly as set forth in claim 19 characterized in that the twisting portion comprises projections and recesses on each of the first and second surfaces, the recesses on each surface being dimensioned to receive the projections on the other surface, the opposed surfaces which extend helically comprising surfaces of the projections which are opposed to surfaces of the recesses.

* * * * *